US009286845B2

(12) United States Patent
Kimura

(10) Patent No.: US 9,286,845 B2
(45) Date of Patent: Mar. 15, 2016

(54) LIQUID CRYSTAL DISPLAY DEVICE AND METHOD OF DRIVING THE SAME

(75) Inventor: Kenichi Kimura, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 192 days.

(21) Appl. No.: 14/131,239

(22) PCT Filed: May 29, 2012

(86) PCT No.: PCT/JP2012/063721

§ 371 (c)(1),
(2), (4) Date: Jan. 7, 2014

(87) PCT Pub. No.: WO2013/011744

PCT Pub. Date: Jan. 24, 2013

(65) Prior Publication Data

US 2014/0146097 A1 May 29, 2014

(30) Foreign Application Priority Data

Jul. 15, 2011 (JP) ..... 2011-156940

(51) Int. Cl.

| | |
|---|---|
| ***G09G 5/10*** | (2006.01) |
| ***G09G 3/36*** | (2006.01) |
| ***G09G 3/20*** | (2006.01) |

(52) U.S. Cl.

CPC ..... *G09G 3/3648* (2013.01); *G09G 3/2003* (2013.01); *G09G 2320/0233* (2013.01);
(Continued)

(58) Field of Classification Search

CPC ..... G09G 2320/0233; G09G 2360/16; G09G 3/3607; G09G 2300/0809; G09G 2320/0209; G09G 2320/0252; G09G 2300/0452; G09G 2310/0218; G09G 2320/0242; G09G 3/3648

See application file for complete search history.

(56) References Cited

U.S. PATENT DOCUMENTS

2003/0016203 A1* 1/2003 Kawano ..... G09G 3/3648 345/100
2006/0268186 A1* 11/2006 Kamada ..... G02F 1/136213 349/38

(Continued)

FOREIGN PATENT DOCUMENTS

JP 2009-104055 A 5/2009
JP 2009-267902 A * 12/2009 ..... G09G 5/10

(Continued)

OTHER PUBLICATIONS

Official Communication issued in International Patent Application No. PCT/JP2012/063721, mailed on Jun. 26, 2012.

*Primary Examiner* — Aneeta Yodichkas
*Assistant Examiner* — Gerald Oliver
(74) *Attorney, Agent, or Firm* — Keating & Bennett, LLP

(57) ABSTRACT

An adjacent gradation correcting unit 11 performs processing for correcting gradations of sub-pixels to a video signal X2 after overshoot processing. When determining that a gradation of a target sub-pixel corresponds to a higher liquid crystal application voltage than that of a gradation of an adjacent sub-pixel, and that a gradation difference between the target sub-pixel and the adjacent sub-pixel is large, the adjacent gradation correcting unit 11 corrects the gradation of the adjacent sub-pixel so as to make the gradation difference smaller. In driving a liquid crystal panel 1, a video signal X3 after correction obtained by the adjacent gradation correcting unit 11 is used. With this, when displaying a specific color, such as red, green, or blue, it is possible to suppress a lateral electric field occurring between two sub-pixels that are adjacent to each other, and to improve response speed of the liquid crystal panel 1.

11 Claims, 6 Drawing Sheets

(52) U.S. Cl.
CPC ..... *G09G2320/0242* (2013.01); *G09G 2320/0252* (2013.01); *G09G 2320/0285* (2013.01); *G09G 2340/16* (2013.01)

(56) References Cited

U.S. PATENT DOCUMENTS

| | | | | |
|---|---|---|---|---|
| 2007/0058199 | A1* | 3/2007 | Kawano | G03G 15/556 358/3.01 |
| 2009/0109210 | A1 | 4/2009 | Ito | |
| 2010/0098349 | A1* | 4/2010 | Arashima | G09G 3/3648 382/263 |
| 2011/0141130 | A1* | 6/2011 | Yagiura | G09G 3/003 345/589 |
| 2011/0205208 | A1* | 8/2011 | Iisaka | G09G 3/3611 345/211 |
| 2011/0234625 | A1 | 9/2011 | Irie et al. | |
| 2012/0281030 | A1* | 11/2012 | Miyata | G09G 3/3688 345/690 |

FOREIGN PATENT DOCUMENTS

| | | | |
|---|---|---|---|
| JP | 2010-113240 | A | 5/2010 |
| WO | 2010/087051 | A1 | 8/2010 |

* cited by examiner

8

| | | GRADATION OF CURRENT FRAME | | | | | |
|---|---|---|---|---|---|---|---|
| | | 0 | 4 | 8 | 16 | ··· | 255 |
| GRADATION OF PREVIOUS FRAME | 0 | 0 | 10 | 20 | 25 | ··· | 255 |
| | 4 | 0 | 4 | 18 | 23 | ··· | 255 |
| | 8 | 0 | 0 | 8 | 20 | ··· | 255 |
| | 16 | 0 | 0 | 2 | 16 | ··· | 255 |
| | ⋮ | ⋮ | ⋮ | ⋮ | ⋮ | ⋱ | ⋮ |
| | 255 | 0 | 0 | 0 | 0 | ··· | 255 |

12

| GRADAION OF TARGET SUB-PIXEL | MINIMUM GRADAION OF ADJACENT SUB-PIXEL |
|---|---|
| 240 | 10 |
| 241 | 11 |
| 242 | 12 |
| 243 | 13 |
| ⋮ | ⋮ |
| 255 | 25 |

22b

| GRADAION OF TARGET SUB-PIXEL | MINIMUM GRADAION OF ADJACENT SUB-PIXEL |
|---|---|
| 240 | 1 |
| 241 | 2 |
| 242 | 4 |
| 243 | 6 |
| ⋮ | ⋮ |
| 255 | 22 |

LIQUID CRYSTAL DISPLAY DEVICE AND METHOD OF DRIVING THE SAME

TECHNICAL FIELD

The present invention relates to a display device, and in particular, to an active matrix-type liquid crystal display device and a method of driving the same.

BACKGROUND ART

A liquid crystal display device performs overshoot driving (also referred to as overdriving) in order to improve response speed of a liquid crystal panel. The overshoot driving is a driving method for applying, to liquid crystals, a voltage corresponding to a gradation higher than a target gradation when increasing display gradation, and applying, to liquid crystals, a voltage corresponding to a gradation lower than the target gradation when decreasing the display gradation. By performing the overshoot driving, it is possible to increase movement speed of liquid crystal molecules, and to improve the response speed.

A liquid crystal display device performing the overshoot driving has a problem that when displaying a specific color, a lateral electric field occurs between two sub-pixels that are adjacent to each other and the response speed of the liquid crystal panel decreases. This problem will be described with reference to FIGS. 11 and 12. FIGS. 11 and 12 show sections of a liquid crystal panel. The liquid crystal panel is configured such that a liquid crystal layer 92 is sandwiched between two glass substrates 91*a* and 91*b*. The glass substrate 91*a* is provided with thin-film transistors (not depicted), a pixel electrode 93, and the like, and the glass substrate 91*b* is provided with an opposite electrode 94, a color filter 95, and the like. Each of color pixels included in the liquid crystal panel is constituted by three sub-pixels 96*r*, 96*g*, and 96*b*.

The liquid crystal panel illustrated in FIGS. 11 and 12 is assumed to be of a normally-black type. When performing white display after black display, a high voltage VM corresponding to a maximum gradation is applied to the liquid crystal layer 92 for any of the three sub-pixels 96*r*, 96*g*, and 96*b* (see FIG. 11). By contrast, when performing green display after black display, while the same voltage VM applied in the white display is applied to the liquid crystal layer 92 for the sub-pixel 96*g*, voltages applied to the liquid crystal layer 92 for the sub-pixels 96*r* and 96*b* remain substantially zero (see FIG. 12). At this time, lateral electric fields 90 occur between the sub-pixels 96*r* and 96*g*, and between the sub-pixels 96*g* and 96*b*.

When the lateral electric field 90 occurs, a part of the liquid crystal molecules (not depicted) within the liquid crystal layer 92 are inclined in horizontal direction, instead of vertical direction. If the orientation of the liquid crystal molecules is disturbed in this manner, the response speed of the liquid crystal panel decreases. In FIG. 12, the higher the voltage VM is, the stronger the lateral electric fields 90 become and the more easily the response speed decreases. Furthermore, the larger a gradation difference between the two sub-pixels that are adjacent to each other is, the more easily the response speed decreases. For example, in a case of the normally-black type liquid crystal panel employing an RGB method, the response speed is noticeably decreased when displaying red, green, blue, or a color close to any of these colors.

As a method for solving this problem, there has conventionally been known a method of making an overshoot gradation lower than that originally is when display gradation changes from a value around a minimum value to a value around a maximum value, when performing overshoot driving to a normally-black type liquid crystal panel. For example, when performing 256-level gradation display, the overshoot gradation when display gradation changes from 0 to 255 is set to be 240, instead of 255. According to this method, even in the case shown in FIG. 12, by decreasing the voltage VM applied to the liquid crystal layer 92 for the sub-pixel 96*g*, it is possible to suppress the lateral electric fields 90 and to improve the response speed.

Relating to the present invention, it should be noted that Patent Document 1 describes a liquid crystal display device that, when brightness of an image frame changes in an order of a low brightness gradation, the low brightness gradation, and then a middle brightness gradation, replaces the middle brightness gradation with an overshoot gradation that is higher than the middle brightness gradation, and replaces the low brightness gradation immediately before the middle brightness gradation with a gradation for pretilt that is higher than the low brightness gradation, in order to improve video display performance.

PRIOR ART DOCUMENT

Patent Document

[Patent Document 1] Japanese Laid-Open Patent Publication No. 2010-113240

SUMMARY OF THE INVENTION

Problems to be Solved by the Invention

The liquid crystal display device described in Patent Document 1 is not able to solve the problem of decrease of response speed due to a lateral electric field. On the other hand, the method of making an overshoot gradation lower than that originally is (higher than that originally is in a case of a normally-white type) has a problem that the response speed decreases when a lateral electric field does not occur originally. For example, when this method is employed for a normally-black type liquid crystal panel, the response speed when performing white display after black display is lower than that in a case when this method is not employed. It should be noted that the decrease of response speed due to a lateral electric field is not limited to the liquid crystal display device that performs overshoot driving, and may occur in a liquid crystal display device that does not perform overshoot driving.

Thus, an object of the present invention is to provide a liquid crystal display device with improved response speed when displaying a specific color without decreasing the response speed either in white display or in black display.

Means for Solving the Problems

According to a first aspect of the present invention, there is provided an active matrix-type liquid crystal display device, including: a liquid crystal panel configured such that sub-pixels constituting color pixels are arranged two-dimensionally; an adjacent gradation correcting unit configured to correct gradations of the sub-pixels included in a video signal; and a drive circuit configured to drive the liquid crystal panel based on a video signal after correction obtained by the adjacent gradation correcting unit, wherein when the adjacent gradation correcting unit determines that a gradation of a target sub-pixel corresponds to a liquid crystal application voltage higher than that for a gradation of an adjacent sub-pixel, and that a gradation difference between the target sub-pixel and the adjacent sub-pixel is large, the adjacent gradation correcting unit performs correction processing to the video signal for correcting the gradation of the adjacent sub-pixel so as to make the gradation difference smaller.

According to a second aspect of the present invention, in the first aspect of the present invention, the liquid crystal display device further includes an overshoot processing unit configured to perform overshoot processing to an input video signal, wherein the adjacent gradation correcting unit performs the correction processing to a video signal after overshoot processing obtained by the overshoot processing unit.

According to a third aspect of the present invention, in the second aspect of the present invention, the liquid crystal panel is of a normally-black type, and the adjacent gradation correcting unit obtains a second value corresponding to the gradation of the target sub-pixel when the gradation of the target sub-pixel is equal to or greater than a first value, and corrects the gradation of the adjacent sub-pixel to the second value when the gradation of the adjacent sub-pixel is lower than the second value.

According to a fourth aspect of the present invention, in the third aspect of the present invention, the adjacent gradation correcting unit includes a look up table storing minimum gradations of the adjacent sub-pixel in association with the gradations of the target sub-pixel, and performs the correction processing using the look up table.

According to a fifth aspect of the present invention, in the fourth aspect of the present invention, the adjacent gradation correcting unit includes a plurality of the look up tables, and switches between the look up tables used in the correction processing depending on a position of the adjacent sub-pixel with respect to the target sub-pixel.

According to a sixth aspect of the present invention, in the second aspect of the present invention, the liquid crystal panel is of a normally-white type, and the adjacent gradation correcting unit obtains a second value corresponding to the gradation of the target sub-pixel when the gradation of the target sub-pixel is equal to or smaller than a first value, and corrects the gradation of the adjacent sub-pixel to the second value when the gradation of the adjacent sub-pixel is higher than the second value.

According to a seventh aspect of the present invention, in the sixth aspect of the present invention, the adjacent gradation correcting unit includes a look up table storing maximum gradations of the adjacent sub-pixel in association with the gradations of the target sub-pixel, and performs the correction processing using the look up table.

According to an eighth aspect of the present invention, in the seventh aspect of the present invention, the adjacent gradation correcting unit includes a plurality of the look up tables, and switches between the look up tables used in the correction processing depending on a position of the adjacent sub-pixel with respect to the target sub-pixel.

According to a ninth aspect of the present invention, in the first aspect of the present invention, the adjacent gradation correcting unit includes a plurality of lookup tables, and switches between the look up tables used in the correction processing depending on a position of the adjacent sub-pixel with respect to the target sub-pixel.

According to a tenth aspect of the present invention, in the first aspect of the present invention, each of the sub-pixels has a long side and a short side, and the adjacent gradation correcting unit performs the correction processing taking two sub-pixels disposed adjacent on the short side out of four sub-pixels disposed around the target sub-pixel as the adjacent sub-pixel.

According to an eleventh aspect of the present invention, in the first aspect of the present invention, the adjacent gradation correcting unit performs the correction processing taking four sub-pixels disposed around the target sub-pixel as the adjacent sub-pixel.

According to a twelfth aspect of the present invention, in the first aspect of the present invention, the adjacent gradation correcting unit performs the correction processing to an input video signal.

According to a thirteenth aspect of the present invention, there is provided a method of driving an active matrix-type liquid crystal display device having a liquid crystal panel configured such that sub-pixels constituting color pixels are arranged two-dimensionally, the method including the steps of: correcting gradations of the sub-pixels included in a video signal; and driving the liquid crystal panel based on a video signal after correction, wherein in the correcting step, when a gradation of a target sub-pixel is determined to correspond to a liquid crystal application voltage higher than that for gradation of an adjacent sub-pixel, and a gradation difference between the target sub-pixel and the adjacent sub-pixel is determined to be large, correction processing is performed to the video signal for correcting the gradation of the adjacent sub-pixel so as to make the gradation difference smaller.

Effects of the Invention

According to the first or the thirteenth aspect of the present invention, the gradation of the adjacent sub-pixel is corrected so as to make the gradation difference smaller when the gradation difference between the target sub-pixel and the adjacent sub-pixel is large. With this, it is possible to suppress a lateral electric field occurring between two sub-pixels that are adjacent to each other, and to improve response speed of the liquid crystal panel. Furthermore, since the gradation of the adjacent sub-pixel is corrected so as to correspond to a higher liquid crystal application voltage, the response speed may not decrease as compared to a case in which the correction is not performed. Therefore, it is possible to improve the response speed when displaying a specific color without decreasing the response speed in white display or in black display.

According to the second aspect of the present invention, even when the gradation difference between the two sub-pixels that are adjacent to each other increases due to the overshoot processing, by using the adjacent gradation correcting unit to make the gradation difference smaller, it is possible to suppress a lateral electric field occurring between two sub-pixels that are adjacent to each other, and to improve the response speed when displaying a specific color without decreasing the response speed in white display or in black display.

According to the third aspect of the present invention, when the gradation of the target sub-pixel is high and the gradation of the adjacent sub-pixel is low, the correction to make the gradation of the adjacent sub-pixel higher is performed in accordance with the gradation of the target sub-pixel. With this, it is possible to suppress a lateral electric field occurring between two sub-pixels that are adjacent to each other, and to improve the response speed when displaying a specific color in the normally-black type liquid crystal panel without decreasing the response speed in white display.

According to the fourth aspect of the present invention, by using the look up table storing the minimum gradations of the adjacent sub-pixel in association with the gradations of the target sub-pixel, it is possible to easily configure the adjacent gradation correcting unit suitable for the normally-black type liquid crystal panel.

According to the fifth, the eighth, or the ninth aspect of the present invention, by switching between the look up tables used in the correction processing depending on the position of the adjacent sub-pixel, it is possible to suitably correct the gradation of the adjacent sub-pixel considering the influence given to the target sub-pixel from the adjacent sub-pixel, and to further improve the response speed when displaying a specific color.

According to the sixth aspect of the present invention, when the gradation of the target sub-pixel is low and the gradation of the adjacent sub-pixel is high, the correction to make the gradation of the adjacent sub-pixel lower is performed in accordance with the gradation of the target sub-pixel. With this, it is possible to suppress a lateral electric field occurring between two sub-pixels that are adjacent to each other, and to improve the response speed when displaying a specific color in the normally-white type liquid crystal panel without decreasing the response speed in black display.

According to the seventh aspect of the present invention, by using the look up table storing the maximum gradations of the adjacent sub-pixel in association with the gradations of the target sub-pixel, it is possible to easily configure the adjacent gradation correcting unit suitable for the normally-white type liquid crystal panel.

According to the tenth aspect of the present invention, it is possible to suppress a lateral electric field occurring between the target sub-pixel and each of the two sub-pixels that are adjacent to the target sub-pixel on the short side, and to improve the response speed when displaying a specific color.

According to the eleventh aspect of the present invention, it is possible to suppress a lateral electric field occurring between the target sub-pixel and each of the four sub-pixels around the target sub-pixel, and to improve the response speed when displaying a specific color.

According to the twelfth aspect of the present invention, it is possible to improve the response speed of a liquid crystal display device that does not perform overshoot driving, when displaying a specific color, without decreasing the response speed either in white display or in black display.

MODES FOR CARRYING OUT THE INVENTION

First Embodiment

Figures 1, 2:
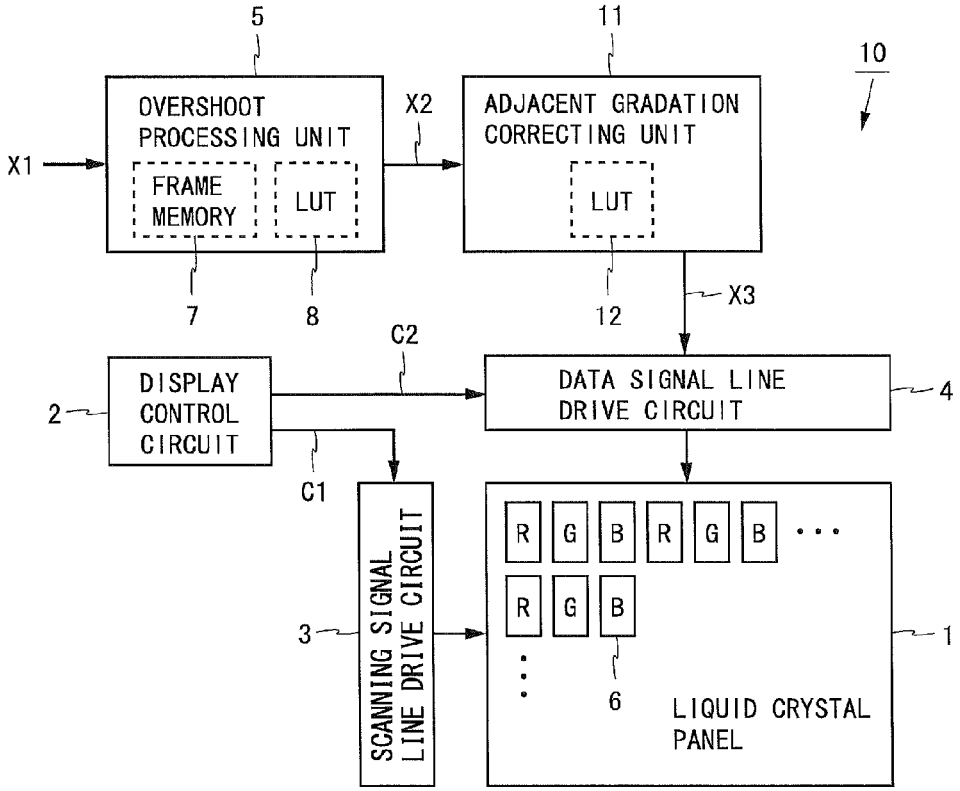
FIG. 1 is a block diagram illustrating a configuration of a liquid crystal display device according to a first embodiment of the present invention.
FIG. 2 is a diagram showing an example of a look up table included in an overshoot processing unit of the liquid crystal display device illustrated in FIG. 1.

FIG. 1 is a block diagram illustrating a configuration of a liquid crystal display device according to a first embodiment of the present invention. A liquid crystal display device 10 illustrated in FIG. 1 is an active matrix-type liquid crystal display device provided with a liquid crystal panel 1, a display control circuit 2, a scanning signal line drive circuit 3, a data signal line drive circuit 4, an overshoot processing unit 5, and an adjacent gradation correcting unit 11. In the following description, m is assumed to be an integer equal to or greater than 2, and n is assumed to be a multiple of 3.

The liquid crystal panel 1 includes m scanning signal lines (not depicted), n data signal lines (not depicted), and (m×n) sub-pixels 6 that are arranged two-dimensionally. The m scanning signal lines are disposed in parallel to each other. The n data signal lines are disposed in parallel to each other so as to intersect with the scanning signal lines perpendicularly. The (m×n) sub-pixels 6 are disposed respectively near intersections between the scanning signal lines and the data signal lines. Each of the sub-pixels 6 includes a thin-film transistor (not depicted) serving as an active element, and functions as one of an R sub-pixel for displaying red, a G sub-pixel for displaying green, and a B sub-pixel for displaying blue. The R sub-pixel, the G sub-pixel, and the B sub-pixel are disposed side by side in a direction along which the scanning signal lines extend (the cross direction in FIG. 1), and these three sub-pixels constitute one color pixel. In the following description, the liquid crystal panel 1 is assumed to be of a normally-black type.

The display control circuit 2 is a control circuit for the liquid crystal display device 10. The display control circuit 2 outputs a control signal C1 to the scanning signal line drive circuit 3, and outputs a control signal C2 to the data signal line drive circuit 4. The control signal C1 includes a gate start pulse and a gate clock, for example. The control signal C2 includes a source start pulse and a source clock, for example.

The scanning signal line drive circuit 3 and the data signal line drive circuit 4 are drive circuits for the liquid crystal panel 1. The scanning signal line drive circuit 3 selects one of the m scanning signal lines based on the control signal C1, and applies a predetermined selection voltage (e.g., a high-level voltage) to the selected scanning signal line. The data signal line drive circuit 4 applies voltages (hereinafter referred to as gradation voltages) corresponding to a video signal X3 after correction outputted from the adjacent gradation correcting unit 11, to the data signal lines based on the control signal C2.

When the selection voltage is applied to one of the scanning signal lines and the gradation voltages are applied to the n data signal lines, the n sub-pixels 6 are respectively applied with the different gradation voltages. Brightness of each sub-pixel 6 changes according to the gradation voltage that has been written. Therefore, it is possible to display a desired image in the liquid crystal panel 1 by writing the gradation voltages to the (m×n) sub-pixels 6 using the scanning signal line drive circuit 3 and the data signal line drive circuit 4.

To the liquid crystal display device 10, a video signal X1 is inputted from outside as an input video signal. The overshoot processing unit 5 performs overshoot processing to the video signal X1, and outputs a video signal X2 after the overshoot processing. The adjacent gradation correcting unit 11 is provided at a stage subsequent to the overshoot processing unit 5 and before the data signal line drive circuit 4. The adjacent gradation correcting unit 11 performs processing for correcting gradations of the sub-pixels to the video signal X2 after the overshoot processing, and outputs the video signal X3 after the correction. The video signal X3 after the correction is supplied to the data signal line drive circuit 4, and is used for driving the liquid crystal panel 1.

As illustrated in FIG. 1, the overshoot processing unit 5 includes a frame memory 7 and a look up table (Look Up Table: hereinafter referred to as a LUT) 8. The frame memory 7 has a capacity in which video signals for at least one frame may be stored. The video signal X1 is stored in the frame memory 7, and is read from the frame memory 7 after one frame period.

FIG. 2 is a diagram showing an example of the LUT 8. As illustrated in FIG. 2, the LUT 8 stores gradations after overshoot processing in association with combinations of gradations of a previous frame and gradations of a current frame. The gradation after overshoot processing is determined to be a gradation higher than the gradation of the current frame when the gradation of the current frame is higher than the gradation of the previous frame, and to be a gradation lower than the gradation of the current frame when the gradation of the current frame is lower than the gradation of the previous frame.

The overshoot processing unit 5 takes out the gradation of the current frame from the video signal X1, and takes out the gradation of the previous frame (gradation corresponding to the gradation of the current frame) the from a video signal read from the frame memory 7. The overshoot processing unit 5 obtains the gradation after overshoot processing by referring to the LUT 8 using the combination of the gradation of the previous frame and the gradation of the current frame. For example, when the gradation of the previous frame is 4 and the gradation of the current frame is 16, the gradation after overshoot processing is 23. It should be noted that when a value corresponding to a combination of two levels of the gradation is not stored in the LUT 8, the overshoot processing unit 5 obtains the gradation after overshoot processing by referring to the LUT 8 plural times using combinations of gradations close to the gradation, and performing interpolation calculation to the obtained values. The overshoot processing unit 5 outputs the video signal X2 after overshoot processing including the gradations obtained by the above processing.

As described above, the overshoot processing unit 5 performs overshoot processing, to the video signal X1, of comparing the gradation of the previous frame with the gradation of the current frame, increasing the gradation of the current frame when the gradation of the current frame is higher than the gradation of the previous frame, and decreasing the gradation of the current frame when the gradation of the current frame is lower than the gradation of the previous frame.

The adjacent gradation correcting unit 11 performs processing to the video signal X2 after overshoot processing, such that when determining that a gradation of a target sub-pixel is higher than a gradation of an adjacent sub-pixel and that a gradation difference between the target sub-pixel and the adjacent sub-pixel is large, the gradation of the adjacent sub-pixel is corrected to be higher so as to make the gradation difference smaller.

Figures 3, 4:
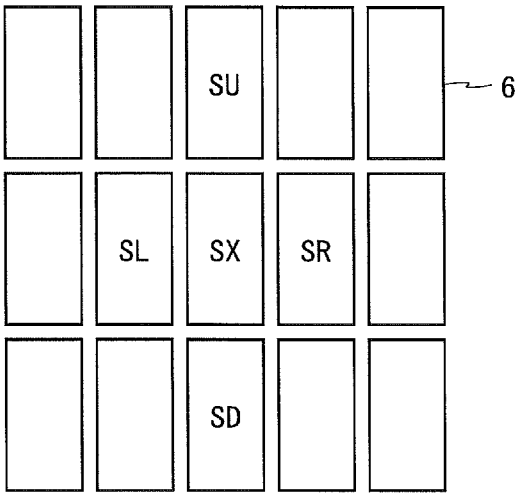
FIG. 3 is a diagram illustrating an arrangement of sub-pixels in a liquid crystal panel of the liquid crystal display device illustrated in FIG. 1.
FIG. 4 is a diagram showing an example of a look up table included in an adjacent gradation correcting unit of the liquid crystal display device illustrated in FIG. 1.

FIG. 3 is a diagram illustrating an arrangement of the sub-pixels in the liquid crystal panel 1. The sub-pixels 6 illustrated in FIG. 3 are in a shape wherein a vertical side is longer than a horizontal side. In FIG. 3, a sub-pixel in the center is referred to as a target sub-pixel SX, and four sub-pixels disposed around the target sub-pixel SX are referred to as a left-side sub-pixel SL, a right-side sub-pixel SR, an up-side sub-pixel SU, and a down-side sub-pixel SD. The target sub-pixel SX is influenced by the surrounding four sub-pixels SL, SR, SU, and SD.

In this embodiment, it is assumed that the influence from the up-side sub-pixel SU and the influence from the down-side sub-pixel SD may be ignored, and that the influence from the left-side sub-pixel SL is comparable to the influence from the right-side sub-pixel SR. The adjacent gradation correcting unit 11 treats the left-side sub-pixel SL and the right-side sub-pixel SR as adjacent sub-pixels. As described above, in this embodiment, the sub-pixels 6 has a long side and a short side, and the two sub-pixels SL and SR that are positioned adjacent on the short side out of the four sub-pixels disposed around the target sub-pixel SX are taken as the adjacent sub-pixels.

As illustrated in FIG. 1, the adjacent gradation correcting unit 11 includes a LUT 12. FIG. 4 is a diagram showing an example of the LUT 12. As illustrated in FIG. 4, the LUT 12 stores minimum gradations of the adjacent sub-pixels in association with gradations of the target sub-pixel. Here, the gradation of the target sub-pixel is the gradation after overshoot processing of the target sub-pixel SX. The minimum gradation of the adjacent sub-pixel is a minimum value of the gradations of the adjacent sub-pixels SL and SR after correction.

The adjacent gradation correcting unit 11 corrects the gradations of the adjacent sub-pixels SL and SR using the LUT 12. More specifically, when the gradation of the target sub-pixel SX is included in a first column of the LUT 12, the adjacent gradation correcting unit 11 reads a minimum gradation of a corresponding adjacent sub-pixel from a second column of the LUT 12 (hereinafter, the read gradation is referred to as Zm). When the gradation of the left-side sub-pixel SL is lower than Zm, the adjacent gradation correcting unit 11 corrects the gradation of the left-side sub-pixel SL to Zm. When the gradation of the right-side sub-pixel SR is lower than Zm, the adjacent gradation correcting unit 11 corrects the gradation of the right-side sub-pixel SR to Zm. When the gradation of the target sub-pixel SX is not included in the first column of the LUT 12, the adjacent gradation correcting unit 11 does not correct the gradation of the left-side sub-pixel SL nor the gradation of the right-side sub-pixel SR.

For example, when the gradation of the target sub-pixel SX is 242 and the gradation of the left-side sub-pixel SL is lower than 12, the adjacent gradation correcting unit 11 corrects the gradation of the left-side sub-pixel SL to 12. When the gradation of the target sub-pixel SX is 255 and the gradation of the left-side sub-pixel SL is lower than 25, the adjacent gradation correcting unit 11 corrects the gradation of the left-side sub-pixel SL to 25. When the gradation of the target sub-pixel SX is 200, the adjacent gradation correcting unit 11 does not correct the gradation of the left-side sub-pixel SL. In the LUT 12 shown in FIG. 4, a difference between the gradation of the target sub-pixel and the minimum gradation of the corresponding adjacent sub-pixel is 230. Therefore, by correcting the gradation of the sub-pixel using the LUT 12 shown in FIG. 4, it is possible to make the gradation difference between the target sub-pixel and the adjacent sub-pixel to be equal to or smaller than 230.

Figure 5:
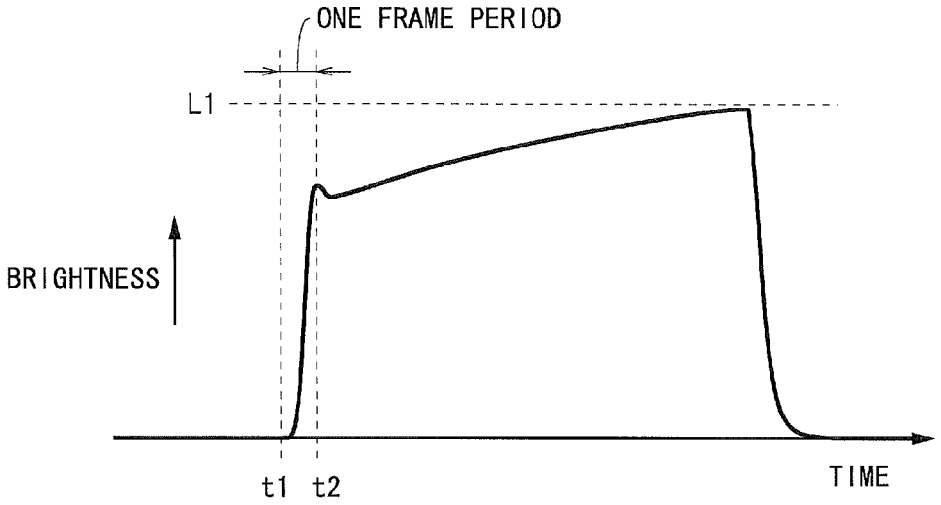
FIG. 5 is a chart showing an example of a response waveform of a conventional liquid crystal display device.
Figure 12:
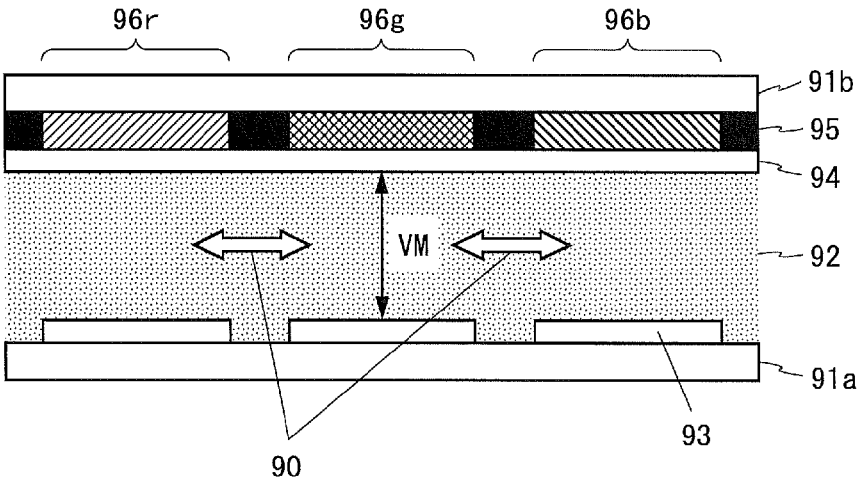
FIG. 12 is a diagram illustrating a liquid crystal application voltage and lateral electric fields when green display is performed by the liquid crystal display device.

Hereinafter, effects of the liquid crystal display device 10 according to this embodiment will be described as compared to a conventional liquid crystal display device without an adjacent gradation correcting unit. As illustrated in FIG. 12, when performing green display after black display in the conventional liquid crystal display device, a lateral electric field 90 occurs between two sub-pixels that are adjacent to each other, and an orientation of liquid crystal molecules is disturbed. FIG. 5 is a chart showing a response waveform of the conventional liquid crystal display device when performing green display after black display. In FIG. 5, brightness of the pixel starts to change at time t1, and reaches about 75% of final brightness L1 at time t2 after one frame period. Then, the brightness of the pixel gradually increases and reaches the final brightness L1 after 10 frame periods or so. When performing green display after black display in the conventional liquid crystal display device in this manner, a lateral electric field occurs between two sub-pixels that are adjacent to each other, and the response speed of the liquid crystal panel decreases.

As a method for solving this problem, a method of making an overshoot gradation lower than that originally is when the display gradation changes from a value around a minimum value to a value around a maximum value is conceivable. However, this method has a problem that the response speed decreases when a lateral electric field does not occur originally (for example, when performing white display).

Figure 6:
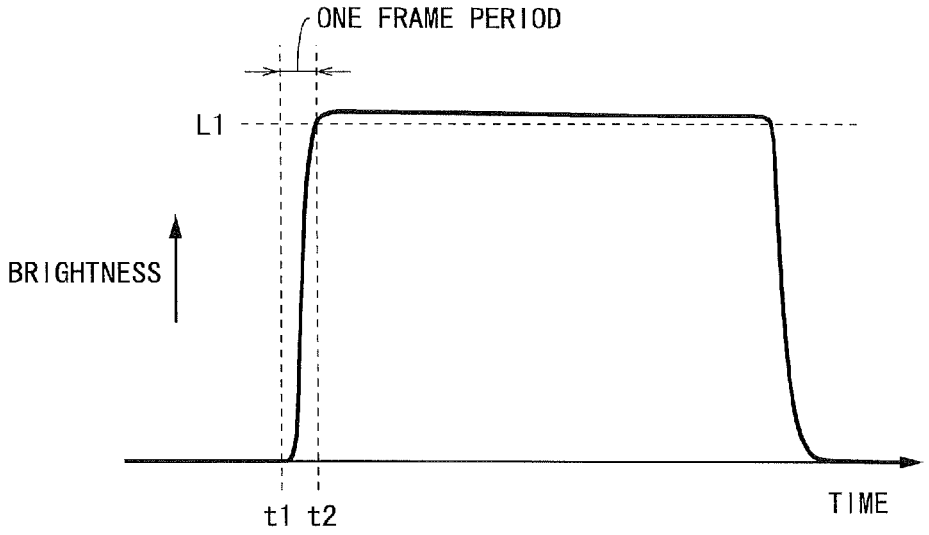
FIG. 6 is a chart showing an example of a response waveform of the liquid crystal display device illustrated in FIG. 1.

By contrast, in the liquid crystal display device 10 according to this embodiment, the adjacent gradation correcting unit 11 performs processing to the video signal X2 after overshoot processing, such that when the gradation difference between the target sub-pixel and the adjacent sub-pixel is large, the gradation of the adjacent sub-pixel is corrected so as to make the gradation difference smaller. With this, even when performing green display after black display, it is possible to suppress a lateral electric field occurring between two sub-pixels that are adjacent to each other, and to suppress the orientation disturbance of the liquid crystal molecules. FIG. 6 is a chart showing a response waveform when performing green display after black display in the liquid crystal display device 10 according to this embodiment. In FIG. 6, the brightness of the pixel starts to change at time t1, and reaches the final brightness L1 at time t2 after one frame period. As described above, according to the liquid crystal display device 10, it is possible to suppress a lateral electric field occurring between two sub-pixels that are adjacent to each other, and to improve the response speed when displaying a specific color, such as red, green, or blue.

Furthermore, since the adjacent gradation correcting unit 11 corrects the gradation of the adjacent sub-pixel to be higher (that is, so as to correspond to a higher liquid crystal application voltage), the response speed may not decrease as compared to a case in which the correction is not performed. Therefore, it is possible to improve the response speed when displaying a specific color without decreasing the response speed in white display.

As described above, according to the liquid crystal display device 10 of this embodiment, it is possible to improve the response speed when displaying a specific color without decreasing the response speed in white display by correcting the gradation of the adjacent sub-pixel to be higher when the gradation of the target sub-pixel is higher than the gradation of the adjacent sub-pixel (that is, the gradation of the target sub-pixel corresponds to a higher liquid crystal application voltage than that of the gradation of the adjacent sub-pixel), and the gradation difference between the target sub-pixel and the adjacent sub-pixel is large. In particular, even when the gradation difference between the two sub-pixels that are adjacent to each other increases due to the overshoot processing, it is possible to improve the response speed when displaying a specific color without decreasing the response speed in white display.

Moreover, the adjacent gradation correcting unit 11 obtains a second value corresponding to the gradation of the target sub-pixel SX (the minimum gradation of the adjacent sub-pixel stored in the LUT 12) when the gradation of the target sub-pixel SX is equal to or higher than a first value (240 in FIG. 4), and corrects the gradations of the adjacent sub-pixels SL and SR to the second value when the gradations of the adjacent sub-pixels SL and SR are lower than the second value. With this, it is possible to improve the response speed when displaying a specific color in the normally-black type liquid crystal panel 1 without decreasing the response speed in white display. Furthermore, by using the LUT 12 storing the minimum gradations of the adjacent sub-pixel in association with the gradations of the target sub-pixel, it is possible to easily configure the adjacent gradation correcting unit 11 suitable for the normally-black type liquid crystal panel 1. Moreover, by taking the two sub-pixels SL and SR positioned adjacent on the short side as the adjacent sub-pixels, it is possible to suppress a lateral electric field occurring between the target sub-pixel SX and the two sub-pixels SL and SR, and to improve the response speed when displaying a specific color.

Second Embodiment

Figures 7, 8:
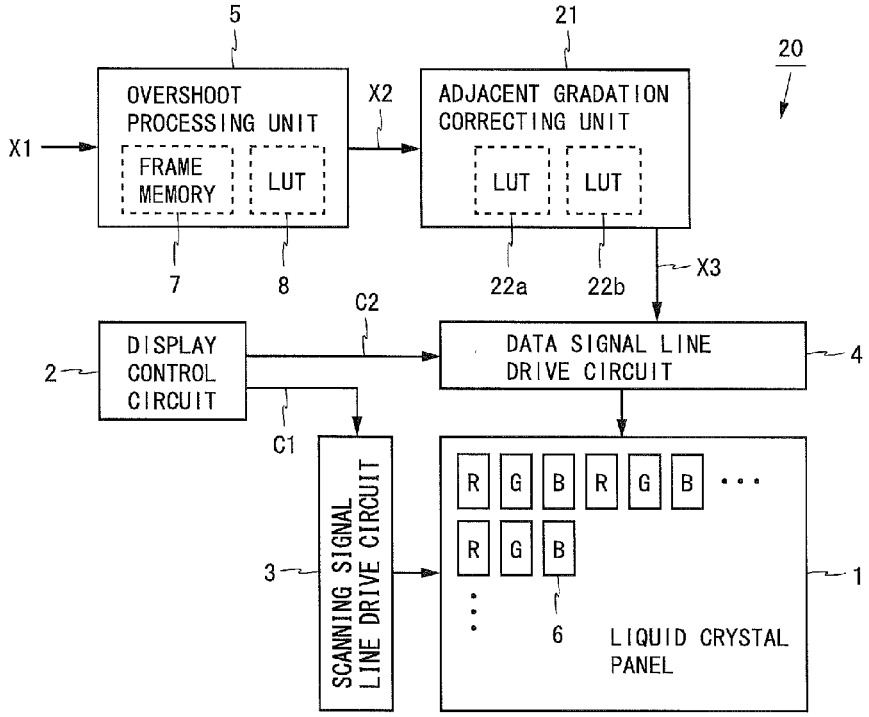
FIG. 7 is a block diagram illustrating a configuration of a liquid crystal display device according to a second embodiment of the present invention.
FIG. 8 is a diagram showing an example of a look up table included in an adjacent gradation correcting unit of the liquid crystal display device illustrated in FIG. 7.

FIG. 7 is a block diagram illustrating a configuration of a liquid crystal display device according to a second embodiment of the present invention. A liquid crystal display device 20 illustrated in FIG. 7 is configured such that the adjacent gradation correcting unit 11 in the liquid crystal display device 10 according to the first embodiment is replaced with an adjacent gradation correcting unit 21. Components in the following embodiments that are the same as those described in preceding embodiments are denoted by the same reference numerals and the descriptions will be omitted.

Similarly to the adjacent gradation correcting unit 11, the adjacent gradation correcting unit 21 is provided at a stage subsequent to the overshoot processing unit 5 and before the data signal line drive circuit 4. The adjacent gradation correcting unit 21 performs processing for correcting gradations of the sub-pixels to the video signal X2 after the overshoot processing, and outputs the video signal X3 after the correction. The adjacent gradation correcting unit 21 includes two LUTs 22*a* and 22*b*. As the LUT 22*a*, the LUT 12 illustrated in FIG. 4 is used, for example. FIG. 8 is a diagram showing an example of the LUT 22*b*. The LUT 22*b* has the same configuration as that of the LUT 22*a*. The content of the LUT 22*b* is different from that of the LUT 22*a*.

In this embodiment, it is assumed that the influence from the up-side sub-pixel SU and the influence from the down-side sub-pixel SD may be ignored, and that the influence from the left-side sub-pixel SL is greater than the influence from the right-side sub-pixel SR. The adjacent gradation correcting unit 21 treats the left-side sub-pixel SL and the right-side sub-pixel SR as adjacent sub-pixels.

The adjacent gradation correcting unit 21 corrects the gradation of the left-side sub-pixel SL using the LUT 22*a*, and corrects the gradation of the right-side sub-pixel SR using the LUT 22*b*. More specifically, when the gradation of the target sub-pixel SX is included in a first column of the LUT 22*a*, the adjacent gradation correcting unit 21 reads a minimum gradation of a corresponding adjacent sub-pixel from a second column of the LUT 22*a* (hereinafter, the read gradation is referred to as Zma). When the gradation of the left-side sub-pixel SL is lower than Zma, the adjacent gradation correcting unit 21 corrects the gradation of the left-side sub-pixel SL to Zma. When the gradation of the target sub-pixel SX is not included in the first column of the LUT 22*a*, the adjacent gradation correcting unit 21 does not correct the gradation of the left-side sub-pixel SL.

When the gradation of the target sub-pixel SX is included in a first column of the LUT 22*b*, the adjacent gradation correcting unit 21 reads a minimum gradation of a corresponding adjacent sub-pixel from a second column of the LUT 22*b* (hereinafter, the read gradation is referred to as Zmb). When the gradation of the right-side sub-pixel SR is lower than Zmb, the adjacent gradation correcting unit 21 corrects the gradation of the right-side sub-pixel SR to Zmb. When the gradation of the target sub-pixel SX is not included in the first column of the LUT 22*b*, the adjacent gradation correcting unit 21 does not correct the gradation of the right-side sub-pixel SR.

As described above, according to the liquid crystal display device 20 of this embodiment, the adjacent gradation correcting unit 21 includes the plurality of LUTs 22*a* and 22*b*, and the LUTs used in the correction processing are switched depending on positions of the adjacent sub-pixels SL and SR with respect to the target sub-pixel SX. Therefore, according to the liquid crystal display device 20 of this embodiment, it is possible to suitably correct the gradations of the adjacent sub-pixels SL and SR considering the influence given to the target sub-pixel SX from the adjacent sub-pixels SL and SR, and to further improve the response speed when displaying a specific color.

Third Embodiment

Figure 9:
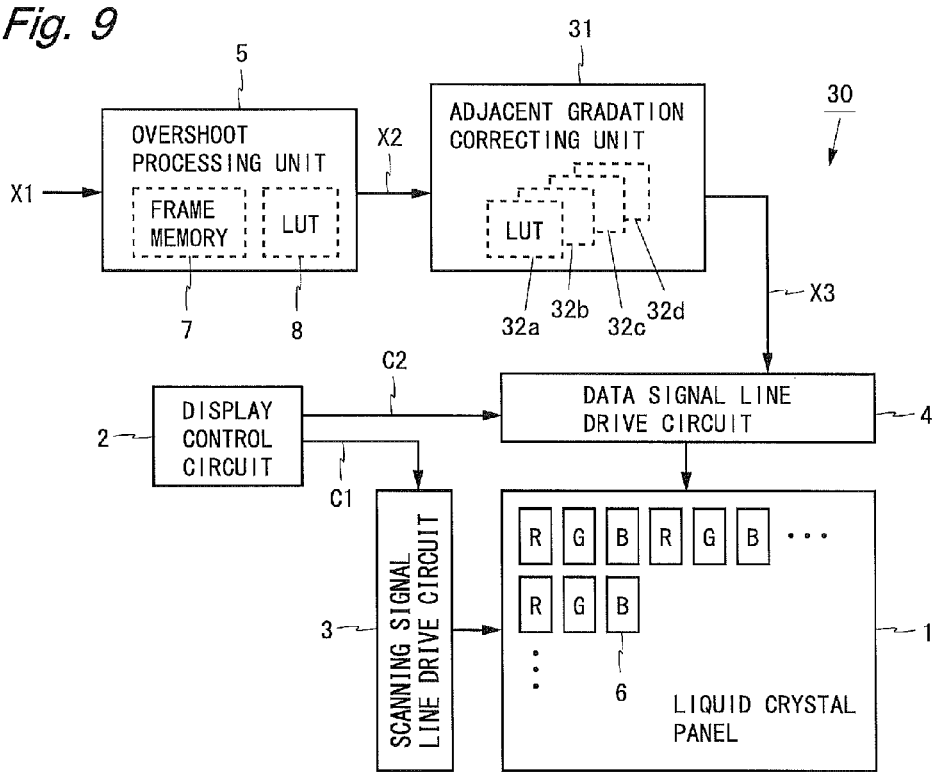
FIG. 9 is a block diagram illustrating a configuration of a liquid crystal display device according to a third embodiment of the present invention.

FIG. 9 is a block diagram illustrating a configuration of a liquid crystal display device according to a third embodiment of the present invention. A liquid crystal display device 30 illustrated in FIG. 9 is configured such that the adjacent gradation correcting unit 11 in the liquid crystal display device 10 according to the first embodiment is replaced with an adjacent gradation correcting unit 31.

Similarly to the adjacent gradation correcting unit 11, the adjacent gradation correcting unit 31 is provided at a stage subsequent to the overshoot processing unit 5 and before the data signal line drive circuit 4. The adjacent gradation correcting unit 31 performs processing for correcting gradations of the sub-pixels to the video signal X2 after the overshoot processing, and outputs the video signal X3 after the correction. The adjacent gradation correcting unit 31 includes four LUTs 32*a* to 32*d*. The LUTs 32*a* to 32*d* have the same configuration as that of the LUT 12 illustrated in FIG. 4. The contents of the LUTs 32*a* to 32*d* are different from each other.

In this embodiment, it is assumed that it is necessary to consider the influences from all of the left-side sub-pixel SL, the right-side sub-pixel SR, the up-side sub-pixel SU, and the down-side sub-pixel SD, and that degrees of these four influences are different from each other. The adjacent gradation correcting unit 31 treats the left-side sub-pixel SL, the right-side sub-pixel SR, the up-side sub-pixel SU, and the down-side sub-pixel SD as adjacent sub-pixels.

The adjacent gradation correcting unit 31 corrects the gradation of the adjacent sub-pixel SL using the LUT 32*a*. More specifically, when the gradation of the target sub-pixel SX is included in a first column of the LUT 32*a*, the adjacent gradation correcting unit 31 reads a minimum gradation of a corresponding adjacent sub-pixel from a second column of the LUT 32*a* (hereinafter, the read gradation is referred to as Zma). When the gradation of the left-side sub-pixel SL is lower than Zma, the adjacent gradation correcting unit 31 corrects the gradation of the left-side sub-pixel SL to Zma. When the gradation of the target sub-pixel SX is not included in the first column of the LUT 32*a*, the adjacent gradation correcting unit 31 does not correct the gradation of the left-side sub-pixel SL. Similarly, the adjacent gradation correcting unit 31 corrects the gradation of the right-side sub-pixel SR using the LUT 32*b*, corrects the gradation of the up-side sub-pixel SU using the LUT 32*c*, and corrects the gradation of the down-side sub-pixel SD using the LUT 32*d*.

As described above, according to the liquid crystal display device 30 of this embodiment, the adjacent gradation correcting unit 31 includes the plurality of LUTs 32*a* to 32*d*, and the LUTs used in the correction processing are switched depending on positions of the adjacent sub-pixels SL, SR, SU, and SD with respect to the target sub-pixel SX. Therefore, according to the liquid crystal display device 30 of this embodiment, it is possible to suitably correct the gradations of the adjacent sub-pixels SL, SR, SU, and SD considering the influence given to the target sub-pixel SX from the adjacent sub-pixels SL, SR, SU, and SD, and to further improve the response speed when displaying a specific color.

Furthermore, according to the liquid crystal display device 30 of this embodiment, the adjacent gradation correcting unit 31 treats the four sub-pixels SL, SR, SU, and SD disposed around the target sub-pixel SX as the adjacent sub-pixels. With this, it is possible to suppress a lateral electric field occurring between the target sub-pixel SX and the four sub-pixels SL, SR, SU, and SD disposed therearound, and to improve the response speed when displaying a specific color. It should be noted that when all of the four influences are at a comparative level, it is sufficient that the adjacent gradation correcting unit may include one LUT. In this case, the adjacent gradation correcting unit uses the same LUT when correcting the gradation of any of the adjacent sub-pixels SL, SR, SU, and SD. Furthermore, when the influence from the left-side sub-pixel SL and the influence from the right-side sub-pixel SR are at a comparative level, and the influence from the up-side sub-pixel SU and the influence from the down-side sub-pixel SD are at a comparative level, the adjacent gradation correcting unit may include two LUTs. In this case, the adjacent gradation correcting unit uses one of the LUTs when correcting the gradation of the left-side sub-pixel SL or the right-side sub-pixel SR, and the other of the LUTs when correcting the gradation of the up-side sub-pixel SU or the down-side sub-pixel SD.

Forth Embodiment

Figure 10:
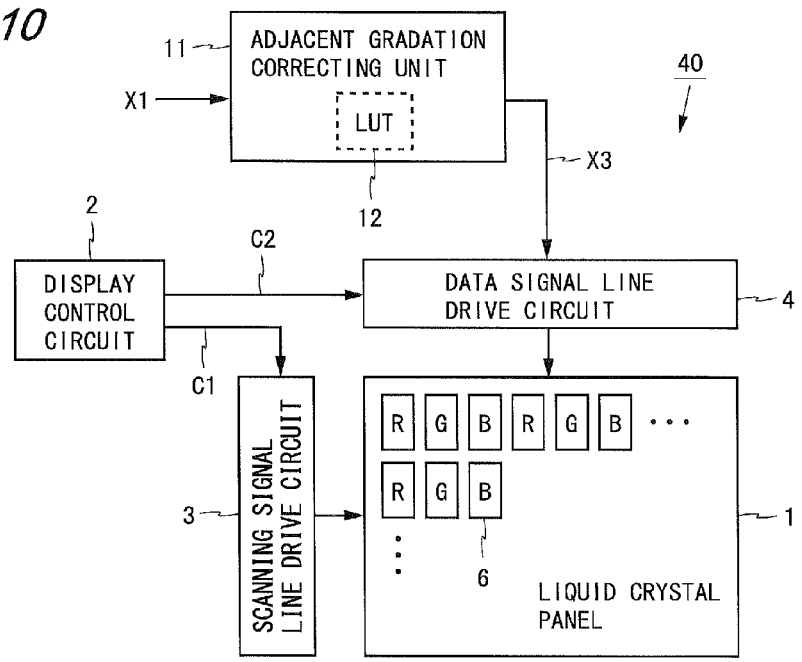
FIG. 10 is a block diagram illustrating a configuration of a liquid crystal display device according to a fourth embodiment of the present invention.
Figure 11:
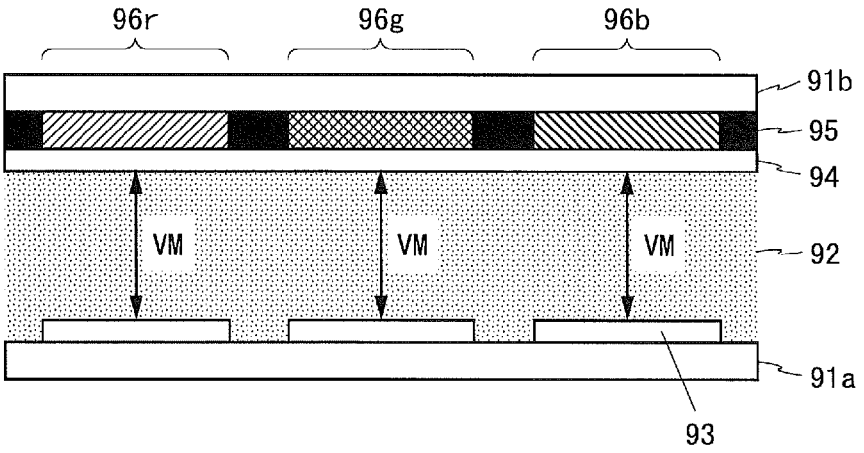
FIG. 11 is a diagram illustrating a liquid crystal application voltage when white display is performed by the liquid crystal display device.

FIG. 10 is a block diagram illustrating a configuration of a liquid crystal display device according to a forth embodiment of the present invention. A liquid crystal display device 40 illustrated in FIG. 10 is provided with the liquid crystal panel 1, the display control circuit 2, the scanning signal line drive circuit 3, the data signal line drive circuit 4, and the adjacent gradation correcting unit 11. The liquid crystal display device 40 is configured such that the overshoot processing unit 5 is removed from the liquid crystal display device 10 according to the first embodiment.

In the liquid crystal display device 40, the adjacent gradation correcting unit 11 is provided at a stage before the data signal line drive circuit 4. The video signal X1 is inputted to the adjacent gradation correcting unit 11. The adjacent gradation correcting unit 11 performs processing for correcting gradations of the sub-pixels to the video signal X1, and outputs the video signal X3 after the correction. The video signal X3 after the correction is supplied to the data signal line drive circuit 4, and is used for driving the liquid crystal panel 1.

As described above, the decrease of response speed due to a lateral electric field is not limited to the liquid crystal display device that performs overshoot driving, and may occur in a liquid crystal display device that does not perform overshoot driving. According to the liquid crystal display device 40 of this embodiment, it is possible to improve the response speed of a liquid crystal display device that does not perform overshoot driving, when displaying a specific color, without decreasing the response speed either in white display or in black display.

It should be noted that it is possible to configure a similar liquid crystal display device by removing the overshoot processing unit 5 from the liquid crystal display device 20 or 30 according to the second or the third embodiment.

All of the liquid crystal display devices described above are provided with the normally-black type liquid crystal panel 1. However, the liquid crystal display device according to the present invention may be provided with a normally-white type liquid crystal panel. In the liquid crystal display device provided with the normally-white type liquid crystal panel, when determining that the gradation of the target sub-pixel is lower than the gradation of the adjacent sub-pixel (that is, the gradation of the target sub-pixel corresponds to a higher liquid crystal application voltage than that of the gradation of the adjacent sub-pixel), and that the gradation difference between the target sub-pixel and the adjacent sub-pixel is large, the adjacent gradation correcting unit corrects the gradation of the adjacent sub-pixel to be lower so as to make the gradation difference smaller (that is, corrects such that the gradation of the adjacent sub-pixel corresponds to the higher liquid crystal application voltage).

For example, the adjacent gradation correcting unit may obtain a second value corresponding to the gradation of the target sub-pixel when the gradation of the target sub-pixel is equal to or lower than a first value, and correct the gradation of the adjacent sub-pixel to the second value when the gradation of the adjacent sub-pixel is higher than the second value. Such an adjacent gradation correcting unit may be easily configured by using a LUT storing the maximum gradations of the adjacent sub-pixel in association with the gradations of the target sub-pixel. Furthermore, the adjacent gradation correcting unit may include a plurality of LUTs, and the LUTs used in the correction processing may be switched depending on the positions of the adjacent sub-pixels with respect to the target sub-pixel. In the liquid crystal display device according to the modified examples described above, when the gradation of the target sub-pixel is low, and the gradation of the adjacent sub-pixel is high, the correction to make the gradation of the adjacent sub-pixel lower is performed in accordance with the gradation of the target sub-pixel. With this, it is possible to suppress a lateral electric field occurring between two sub-pixels that are adjacent to each other, and to improve the response speed when displaying a specific color in the normally-white type liquid crystal panel without decreasing the response speed in black display.

Summarizing the above, when determining that the gradation of the target sub-pixel corresponds to a higher liquid crystal application voltage than that of the gradation of the adjacent sub-pixel, and that the gradation difference between the target sub-pixel and the adjacent sub-pixel is large, the adjacent gradation correcting unit may perform processing to a video signal for correcting the gradations of the adjacent sub-pixels so as to make the gradation difference smaller. According to the liquid crystal display device of the present invention provided with such an adjacent gradation correcting unit, it is possible to improve the response speed when displaying a specific color without decreasing the response speed either in white display or in black display.

INDUSTRIAL APPLICABILITY

The liquid crystal display device according to the present invention may be used as a display device in various applications, because it has a characteristic that the response speed when displaying a specific color can be improved without decreasing the response speed either in white display or in black display.

DESCRIPTION OF REFERENCE CHARACTERS

1: Liquid Crystal Panel
2: Display Control Circuit
3: Scanning Signal Line Drive Circuit
4: Data Signal Line Drive Circuit
5: Overshoot Processing Unit
6, 96: Sub-Pixel
7: Frame Memory
8, 12, 22, 32: LUT
10, 20, 30, 40: Liquid Crystal Display Device
11, 21, 31: Adjacent Gradation Correcting Unit
90: Lateral Electric Field

The invention claimed is:

1. An active matrix-type liquid crystal display device, comprising:

a liquid crystal panel configured such that sub-pixels constituting color pixels are arranged two-dimensionally;

an adjacent gradation correcting unit configured to correct gradations of the sub-pixels included in a video signal; and a drive circuit configured to drive the liquid crystal panel based on a video signal after correction obtained by the adjacent gradation correcting unit, wherein when the adjacent gradation correcting unit determines a gradation of a target sub-pixel corresponds to a liquid crystal application voltage is higher than for a gradation of an adjacent sub-pixel, and that a gradation difference between the target sub-pixel and the adjacent sub-pixel is large, the adjacent gradation correcting unit performs correction processing to the video signal for correcting the gradation of the adjacent sub-pixel so as to make the gradation difference smaller, each of the sub-pixels has a long side and a short side, and the adjacent gradation correcting unit performs the correction processing taking two sub-pixels disposed adjacent on the short side out of four sub-pixels disposed around the target sub-pixel as the adjacent sub-pixel.

2. The liquid crystal display device according to claim 1, further comprising:

an overshoot processing unit configured to perform overshoot processing to an input video signal, wherein the adjacent gradation correcting unit performs the correction processing to a video signal after overshoot processing obtained by the overshoot processing unit.

3. The liquid crystal display device according to claim 2, wherein the liquid crystal panel is of a normally-black type, and the adjacent gradation correcting unit obtains a second value corresponding to the gradation of the target sub-pixel when the gradation of the target sub-pixel is equal to or greater than a first value, and corrects the gradation of the adjacent sub-pixel to the second value when the gradation of the adjacent sub-pixel is lower than the second value.

4. The liquid crystal display device according to claim 3, wherein the adjacent gradation correcting unit includes a look up table storing minimum gradations of the adjacent sub-pixel in association with the gradations of the target sub-pixel, and performs the correction processing using the look up table.

5. The liquid crystal display device according to claim 4, wherein the adjacent gradation correcting unit includes a plurality of the look up tables, and switches between the look up tables used in the correction processing depending on a position of the adjacent sub-pixel with respect to the target sub-pixel.

6. The liquid crystal display device according to claim 2, wherein the liquid crystal panel is of a normally-white type, and the adjacent gradation correcting unit obtains a second value corresponding to the gradation of the target sub-pixel when the gradation of the target sub-pixel is equal to or smaller than a first value, and corrects the gradation of the adjacent sub-pixel to the second value when the gradation of the adjacent sub-pixel is higher than the second value.

7. The liquid crystal display device according to claim 6, wherein the adjacent gradation correcting unit includes a look up table storing maximum gradations of the adjacent sub-pixel in association with the gradations of the target sub-pixel, and performs the correction processing using the look up table.

8. The liquid crystal display device according to claim 7, wherein the adjacent gradation correcting unit includes a plurality of the look up tables, and switches between the look up tables used in the correction processing depending on a position of the adjacent sub-pixel with respect to the target sub-pixel.

9. The liquid crystal display device according to claim 1, wherein the adjacent gradation correcting unit includes a plurality of look up tables, and switches between the look up tables used in the correction processing depending on a position of the adjacent sub-pixel with respect to the target sub-pixel.

10. The liquid crystal display device according to claim 1, wherein the adjacent gradation correcting unit performs the correction processing to an input video signal.

11. A method of driving an active matrix-type liquid crystal display device having a liquid crystal panel configured such that sub-pixels constituting color pixels are arranged two-dimensionally, the method comprising the steps of:

correcting gradations of the sub-pixels included in a video signal; and driving the liquid crystal panel based on a video signal after correction, wherein in the correcting step, when a gradation of a target sub-pixel is determined to correspond to a liquid crystal application voltage higher than that for gradation of an adjacent sub-pixel, and a gradation difference between the target sub-pixel and the adjacent sub-pixel is determined to be large, correction processing is performed to the video signal for correcting the gradation of the adjacent sub-pixel so as to make the gradation difference smaller, each of the sub-pixels has a long side and a short side, and in the correcting step, the correction processing is performed taking two sub-pixels disposed adjacent on the short side out of four sub-pixels disposed around the target sub-pixel as the adjacent sub-pixel.

* * * * *